US006238804B1

(12) United States Patent
Atherton et al.

(10) Patent No.: US 6,238,804 B1
(45) Date of Patent: May 29, 2001

(54) INK JET RECORDING MEDIUM HAVING A COATING CONTAINING CELLULOSE ETHERS AND OPTICAL BRIGHTENERS

(75) Inventors: David Atherton, Saunderstown; Odette Glass, North Kingstown, both of RI (US)

(73) Assignee: Arkwright Incorporated, Fiskeville, RI (US)

( * ) Notice: Subject to any disclaimer, the term of this patent is extended or adjusted under 35 U.S.C. 154(b) by 0 days.

(21) Appl. No.: 09/260,733

(22) Filed: Mar. 3, 1999

Related U.S. Application Data

(60) Provisional application No. 60/076,670, filed on Mar. 3, 1998, now abandoned.

(51) Int. Cl.[7] ..... B41M 5/00

(52) U.S. Cl. ..... 428/532; 428/195; 428/211; 428/412; 428/481; 428/507; 428/509; 428/522; 428/535

(58) Field of Search ..... 428/195, 532, 428/537.5, 211, 412, 481, 507, 509, 522, 535

(56) References Cited

U.S. PATENT DOCUMENTS

| | | |
|---|---|---|
| 5,006,407 | 4/1991 | Malhotra . |
| 5,118,570 | 6/1992 | Malhotra . |
| 5,139,903 | 8/1992 | Malhotra . |
| 5,660,622 | 8/1997 | Nikoloff . |
| 5,766,398 | 6/1998 | Cahill et al. . |
| 5,795,425 | 8/1998 | Brault et al. . |

FOREIGN PATENT DOCUMENTS

| | | |
|---|---|---|
| 2088777A | 6/1982 | (GB) . |

*Primary Examiner*—Pamela R. Schwartz
(74) *Attorney, Agent, or Firm*—Birch, Stewart, Kolasch & Birch, LLP

(57) ABSTRACT

The present invention is directed to an ink jet recording medium, and more particularly to an ink jet recording medium prepared with an ink absorbent coating that is used to receive aqueous dye-based ink. The ink absorbent coating comprises a blend of at least one cellulose ether and stilbene optical brightener. The medium has a ΔE value of no greater than about 5, as measured according to CIE 1976 (L*a*b*) uniform color scale method, after the medium has been imaged with a magenta color-image.

6 Claims, No Drawings

INK JET RECORDING MEDIUM HAVING A COATING CONTAINING CELLULOSE ETHERS AND OPTICAL BRIGHTENERS

CROSS-REFERENCE TO RELATED APPLICATIONS

This application claims the benefit of U.S. provisional application 60/076,670 having a filing date of Mar. 3, 1998, abandoned.

BACKGROUND OF THE INVENTION

1. Field of the Invention

The present invention relates to an ink jet recording medium having a coating for absorbing aqueous dye-based inks. The coating comprises a blend of cellulose ether(s) and stilbene optical brightener(s).

2. Brief Description of the Related Art

The present invention relates to coated ink jet recording media, such as papers and films, which can be color imaged with aqueous dye-based inks from ink jet printers. By "aqueous dye-based inks' as used herein, it is meant ink compositions containing a water-soluble dye, wherein the solvent or carrier liquid is primarily water. In addition to water and dyes, the ink may contain pigments, organic solvents, humectants, detergents, thickeners, preservatives, and the like. The ink jet recording media of this invention are coated with an ink absorbent composition. By an "ink absorbent composition or coating" as used herein, it is meant a composition or coating which absorbs aqueous-dye based inks.

In order to provide high quality color images, ink jet recording media are typically coated with an ink absorbent composition. During imaging or printing with ink jet printers, the ink absorbent coating absorbs the aqueous dye-based ink quickly so that the ink can dry quickly. Ink absorbent (or ink receptive) coatings are known in the art and typically comprise a hydrophilic polymeric material that is soluble in water and swells upon exposure to water. Suitable hydrophilic polymeric materials include, for example, poly(vinyl alcohol), cellulose ethers, cellulose esters, poly(vinyl pyrrolidone), gelatins, poly(vinyl acetate), starch, poly(acrylic acids), poly(ethylene oxide), proteins, hydroxypropyl cyclodextrin, poly(2-ethyl-2-oxazoline), alginates, water-soluble gums, and the like.

It is sometimes desirable to add certain optical brighteners to certain polymeric coatings on ink jet recording media in order to brighten the coatings.

For example, Nikoloff, U.S. Pat. No. 5,660,622 discloses a coating composition for ink jet recording sheets. The composition contains a mixture of hydrated amorphous synthetic silica, synthetic binder, cationic agent, leveling-flow modifier, dispersing agent, optical brightener, and water. In addition, the patent states that the coating may also include titanium dioxide pigment and/or a viscosity modifier. The patent discloses that the water-dispersible synthetic binder may be an acrylic prepolymer or polyvinyl alcohol (PVA), and the viscosity modifier may be alginates, carboxyl methyl cellulose, hydroxyl methyl cellulose, or polyacrylates. The patent states that the preferred optical brightener material includes a stilbene yellow base and is preferably in the coating composition at a weight percent range of 0.2 to 2%.

Cahill et al., U.S. Pat. No. 5,766,398 and Brault et al., U.S. Pat. No. 5,795,425 disclose processes for making protected, distortion-free, full-color ink jet images for use on large format posters, billboards, and the like. The patents disclose that the ink receptive layer on the receptor element may be prepared from a variety of hydrophilic aqueous ink absorptive coating materials. In addition to the polymeric or resin components, the patents disclose that the ink receptive layer typically contains other added components such as a dye mordant, a surfactant, particulate material, a colorant, ultraviolet absorbing materials, organic acids, an optical brightener, and the like. The patent discloses that optical brighteners which may be used to enhance the visual appearance of the imaged layer may be any conventional, compatible optical brightener, e.g., optical brighteners marketed by Ciba-Geigy under the trademark of Tinopal®.

One particular problem with ink jet recording media coated with compositions containing cellulose ethers is that the media exhibit undesirable color shifts after the media have been imaged with a color image. By "color shifts", it is meant that the color of the image changes over time. These color shifts are most noticeable on ink jet recording media having a magenta-colored image. When magenta ink is used to form the image, the image is initially a magenta (deep purplish red) color, but it often fades and appears hot pinkish over a relatively short period of time. It would be desirable to have ink jet recording media, where such magenta color shifts are minimized or eliminated. The present invention provides such ink jet recording media.

SUMMARY OF THE INVENTION

The present invention provides an ink jet recording medium comprising a substrate coated with an ink absorbent composition, comprising a blend of at least one cellulose ether and stilbene optical brightener, wherein no acrylic resin or polyvinyl alcohol is present in the composition. The coating comprises about 1% to about 10%, and more preferably 1 to 5%, by weight stilbene optical brightener. Transparent, translucent, matte and opaque plastic films, and papers can be used as substrates. Preferably, the plastic film comprises polyester, cellulose ester, polystyrene, polypropylene, polyvinyl acetate, polycarbonate, or mixtures thereof Preferably, the paper is a polyethylene-coated or clay-coated paper.

The ink jet recording medium of this invention is further characterized by having a $\Delta E$ value of no greater than about 5, as measured according to CIE 1976 ($L^*a^*b^*$) uniform color scale method, after the medium has been imaged with a magenta color-image. Further, the ink jet recording medium preferably has a whiteness value of at least about 95.

DETAILED DESCRIPTION OF THE INVENTION

The following Detailed Description (including the Examples set forth) is provided as an aid to those desiring to practice the present invention. It is not to be construed as being unduly limiting to the present inventive discovery, since those of ordinary skill in the art will readily recognize that the embodiments of the Inventors' discovery disclosed herein may be modified using standard techniques and materials known in the art without departing from the spirit or scope of the present inventive discovery.

The present invention relates to an ink jet recording medium having an ink absorbent coating which absorbs aqueous dye-based inks. The coating comprises a blend of at least one cellulose ether and stilbene optical brightener. Suitable cellulose ethers for use in this invention include, for example, methylcellulose, hydroxymethylcellulose, ethylcellulose, and hydroxyethylcellulose.

A variety of conventional optical brighteners are used to brighten textiles, paper, detergents, and plastics. Examples of optical brighteners include stilbene derivatives, styryl derivatives of benzene and biphenyl, bic(benzazol-2-yl) derivatives, coumarins, carbostyrils, naphthalamides, derivatives of dibenzothiophene-5,5-dioxide, pyrene derivatives, and pyridotriazoles.

However, for ink jet recording media coated with an ink absorbent composition comprising cellulose ether(s), it has been surprisingly found that not all optical brighteners are effective in substantially eliminating magenta color shifts. The present inventors have discovered that ink absorbent coatings comprising a blend of cellulose ether and stilbene optical brightener possess good color fidelity, and ink jet media coated with such ink absorbent coatings are substantially free from magenta color shifts after magenta color-imaging. Conventional printers, such as the Encad Novajet Pro ink jet, can be used to form the magenta-colored image on the media. By "stilbene optical brighteners", it is meant stilbenes and their derivatives. The stilbene optical brighteners suitable for use in this invention are commercially available and Tinopal® SFP and SCP, available from Ciba-Geigy, are particularly preferred. These stilbene optical brighteners stabilize magenta ink dye and fluoresce, providing the media with a whiter and brighter appearance. As illustrated in the following examples, if another optical brightener is used in place of the stilbene optical brightener, significant magenta color shifts occur on the imaged medium.

The ink absorbent coating comprising cellulose ether(s) and stilbene optical brightener(s) can be prepared and applied to the ink jet recording substrate by conventional methods, as described further below. The stilbene optical brightener is present in the ink absorbent coating in an amount of about 1% to about 10% by weight, and preferably in an amount of 1 to 5 weight %, based on the weight of the coating. While the weight of the coating is not limited to any range, the coating is typically applied to the substrate at a coat weight of about 5 to about 35 grams per meter.

As demonstrated in the following examples, the magenta color-imaged media of this invention possess a color change value, $\Delta E$, of no greater than about 5 as measured by the CIELAB uniform color scale CIE 1976 ($L^*a^*b^*$). The CIELAB uniform color scale is well known in the art and is based on the opponent-colors theory of color vision which states that a color cannot be both green and red at the same time, nor blue and yellow at the same time. Thus, single values are used to describe the red/green and yellow/blue attributes of the color.

Further, the ink jet recording media of this invention preferably possess a whiteness value of at least about 95 as measured on an X-Rite Tristimulus Reflection Colorimeter Model No. 918, using ASTM E313, as further illustrated in the examples.

It is recognized that the ink absorbent coating may contain other conventional polymers and additives typically incorporated in ink absorbent coatings; provided however, that such polymers and additives are compatible with the mixture of cellulose ether and stilbene optical brightener and that the $\Delta E$ value of the magenta color-imaged medium is no greater than about 5. While other hydrophilic polymers may be used in the coating composition, the composition should not comprise an acrylic resin or polyvinyl alcohol. As illustrated in the following examples, a medium coated with a composition containing a mixture of acrylic resin and polyvinyl alcohol exhibited a large magenta color shift and high $\Delta E$ values. Suitable additives include surface active agents that control the wetting or spreading action of the coating solution, antistatic agents, suspending agents, and acidic compounds that control the pH value of the coating solution, inorganic pigments, organic pigments, antifoam agents, and ultraviolet stabilizers.

The ink jet recording media of this invention can be prepared with any conventional substrate material typically used for making ink jet recording media. Such substrate materials include, for example, transparent, translucent, matte and opaque plastic films, and papers. These substrate materials are typically composed of polyester, cellulose esters, polystyrene, polypropylene, polyvinyl acetate, polycarbonate, and the like. Polyester films are particularly preferred substrates. Further, while almost any paper can be used as a substrate, clay-coated papers and polyethylene-coated papers are particularly preferred. The thickness of the substrate is not particularly restricted, but it should generally be in the range of about 1 to about 10 mils and preferably about 3.0 to about 5.0 mils. The substrate may be pretreated to enhance the adhesion of the coating to the substrate.

Any of a number of coating methods may be employed to coat the ink absorbent coating onto the substrate. Methods such as roller coating, blade coating, wire-bar coating, dip coating, extrusion coating, air-knife coating, curtain coating, slide coating, doctor coating or gravure coating, may be used and are well known in the art. The surface of the substrate that does not bear the ink absorbent coating may have a backing material placed thereon in order to reduce electrostatic charge and to reduce sheet-to-sheet friction and sticking, if so desired. The backing material may be a polymeric coating, film, or paper.

EXAMPLES

The present invention is further illustrated by the following examples, but these examples should not be construed as limiting the scope of the invention. In the following examples, parts mean parts by weight, unless otherwise indicated.

Example 1

A coating composition was prepared according to the following formulation.

| | Parts |
|---|---|
| Methocel K3[1] | 6 |
| Methocel A15-LV[2] | 3 |
| Water | 66 |
| Methanol | 11 |
| Isopropanol | 11 |
| Tinopal SCP[3] | 2 |

[1]cellulose ether, available from Dow Chemical.
[2]cellulose ether, available from Dow Chemical.
[3]stilbene-triazine optical brightener, 10%. Solids, available from Ciba-Geigy.

The coating formulation was applied to a polyethylene-coated paper substrate using a number 55 Meyer rod. The coated substrate was dried in an oven at 120° C. for about 3 minutes.

Example 2

A coating composition was prepared according to the following formulation.

| | Parts |
|---|---|
| Methocel K3[1] | 6 |
| Methocel A15-LV[2] | 3 |
| Water | 66 |
| Methanol | 11 |
| Isopropanol | 11 |
| Optiblanc AFW/E[3] | 2 |

[1]·cellulose ether, available from Dow Chemical.
[2]·cellulose ether, available from Dow Chemical.
[3]·stilbene optical brightener derivative, 10% solids, available from 3V Inc.

The coating formulation was applied to a polyethylene-coated paper substrate using a number 55 Meyer rod. The coated substrate was dried in an oven at 120° C. for about 3 minutes.

Example 3

A coating composition was prepared according to the following formulation.

| | Parts |
|---|---|
| Methocel K3[1] | 6 |
| Methocel A1 5-LV[2] | 3 |
| Water | 66 |
| Methanol | 11 |
| Isopropanol | 11 |
| Tinopal SFP[3] | 2 |

[1]·cellulose ether, available from Dow Chemical.
[2]·cellulose ether, available from Dow Chemical.
[3]·stilbene derivative, 10% solids, available from Ciba-Geigy.

The coating was applied to a polyethylene-coated paper substrate using a number 55 Meyer rod. The coated substrate was dried in an oven at 120° C. for about 3 minutes.

Comparative Example A

A coating composition was prepared according to the following formulation.

| | Parts |
|---|---|
| Water | 64 |
| Poly(vinyl) alcohol[1] | 7 |
| Acrysol 1545[2] | 7 |
| Tinopal SFP[3] | 2 |
| Isopropanol | 10 |
| Methanol | 10 |

[1]·Airvol 823, available from Air Products and Chemicals.
[2]·acrylic resin, available from Rohm and Haas.
[3]·stilbene derivative optical brightener, 10% solids, available from Ciba-Geigy.

The coating formulation was applied to a polyethylene-coated paper substrate using a number 55 Meyer rod. The coated substrate was dried in an oven at 120° C. for about 3 minutes.

Comparative Example B

A coating composition was prepared according to the following formulation.

| | Parts |
|---|---|
| Methocel K3[1] | 6 |
| Methocel A1 5LV[2] | 3 |
| Water | 67 |
| Methanol | 12 |
| Isopropanol | 12 |

[1]·cellulose ether, available from Dow Chemical.
[2]·cellulose ether, available from Dow Chemical.

The coating was applied to a polyethylene-coated paper substrate using a number 55 Meyer rod. The coated substrate was dried in an oven at 120° C. for about 3 minutes.

Comparative Example C

A coating composition was prepared according to the following formulation.

| | Parts |
|---|---|
| Methocel K3[1] | 6 |
| Methocel A15-LV[2] | 3 |
| Water | 66 |
| Methanol | 11 |
| Isopropanol | 11 |
| Tinopal SK[3] | 2 |

[1]·cellulose ether, available from Dow Chemical.
[2]·cellulose ether, available from Dow Chemical.
[3]·distyryl biphenyl derivative optical brightener, 10% solids, available from Ciba-Geigy.

The coating was applied to a polyethylene-coated paper substrate using a number 55 Meyer rod. The coated substrate was dried in an oven at 120° C. for about 3 minutes.

The examples and comparative examples were printed on an Encad Nova Jet Pro ink jet printer. Magenta ink color shift results and L*a*b* values are presented in Table 1, below.

TABLE 1

Magenta Color Shift and Whiteness

| Example | Magenta Color Shift | L* | a* | b* | ΔE | W Substrate | W Example | ΔW |
|---|---|---|---|---|---|---|---|---|
| 1 | No | 51 | 91 | −36 | 0 | 84 | 101 | 17 |
| 2 | No | 52 | 91 | −36 | 0 | 84 | 98 | 14 |
| 3 | No | 53 | 91 | −36 | 0 | 84 | 100 | 16 |
| A | Turned Pink | 61 | 87 | −20 | 19.3 | 84 | 111 | 27 |
| B | Turned Pink | 57 | 89 | −28 | 10.2 | 84 | 90 | 6 |
| C | Turned Pink | 57 | 90 | −27 | 10.9 | 84 | 104 | 20 |

In Table 1, the magenta ink color shift was evaluated with an X-Rite, Model 918, Tristimulus Reflection Colorimeter using the standard procedures recommended by X-Rite.

In Table 1, ΔE , a measure of change in color, denoting the total difference or distance on the CIELAB color diagram, was calculated using the following formula.

$$\Delta E=[(L_1^*L_2^*)^2+(a_1^*-a_2^*)^2+(b_1^*-b^*_2)^2]^{1/2}$$

where L* defines lightness, a* denotes the red/green value, and b* denotes the yellow/blue value. Products with lower ΔE values had less color shift, while products with higher ΔE values had greater color shift.

In Table 1, ΔW, a measure of the change in brightness, was measured using ASTM E313, where W substrate was the whiteness value of the uncoated substrate and W Example was the whiteness value of the coated examples and comparative examples. Products with low W values are less white than products with high W values, and products with lower ΔW values had smaller increases in brightness.

As illustrated in Table 1, ΔE values for the ink jet recording media of this invention are zero. In contrast, ΔE values for comparative examples, A–C, are positive, indicating significant color shifts.

We claim:

1. An ink jet recording medium comprising a substrate coated with an ink absorbent composition comprising a blend of cellulose ether and 1 to 5% by weight stilbene optical brightener based on the weight of coated ink absorbent composition, wherein the composition does not comprise any acrylic resin or polyvinyl alcohol, and the medium has a ΔE value of no greater than about 5, as measured according to CIE 1976 (L*a*b*) uniform color scale method, after the medium has been imaged with a magenta color-image.

2. The ink jet recording medium of claim 1, wherein the medium has a whiteness value of at least about 95.

3. The ink jet recording medium of claim 1, wherein the substrate is selected from the group consisting of transparent, translucent, matte, and opaque plastic films.

4. The ink jet recording medium of claim 3, wherein the plastic film comprises a polymer selected from the group consisting of polyester, cellulose ester, polystyrene, polypropylene, poly(vinyl acetate), polycarbonate, and mixtures thereof.

5. The ink jet recording medium of claim 1, wherein the substrate is a paper.

6. The ink jet recording medium of claim 6, wherein the paper is a polyethylene-coated paper or clay-coated paper.

* * * * *